US006862781B2

(12) United States Patent
Emery et al.

(10) Patent No.: US 6,862,781 B2
(45) Date of Patent: Mar. 8, 2005

(54) HYDRAULIC NAPPING OF FABRICS WITH JACQUARD OR DOBBY PATTERNS

(75) Inventors: Nathan B Emery, Spartanburg, SC (US); John R. Farrall, Greenville, SC (US); Robert Hollar, Spartanburg, SC (US); Marion Pittman, Spartanburg, SC (US); Karen H. Stavrakas, Greenville, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 10/404,736

(22) Filed: Apr. 1, 2003

(65) Prior Publication Data

US 2003/0170419 A1 Sep. 11, 2003

Related U.S. Application Data

(62) Division of application No. 09/708,931, filed on Nov. 8, 2000.

(51) Int. Cl.[7] ..... D06C 11/00

(52) U.S. Cl. ..... 26/29 R; 26/30; 28/167; 28/163

(58) Field of Search ..... 26/29 R, 30, 69 R; 28/151, 160, 104, 105, 167, 163, 162; 139/383 R; 442/189, 203, 208; 428/85, 88, 89, 91

(56) References Cited

U.S. PATENT DOCUMENTS

| | | | | | |
|---|---|---|---|---|---|
| 1,987,858 | A | | 1/1935 | Merriman | 139/420 R |
| 4,103,054 | A | * | 7/1978 | Okamoto et al. | 428/91 |
| 4,145,468 | A | * | 3/1979 | Mizoguchi et al. | 442/269 |
| 4,512,065 | A | * | 4/1985 | Otto | 26/28 |
| 4,967,456 | A | | 11/1990 | Sternlieb et al. | 28/104 |
| 4,995,151 | A | | 2/1991 | Siegel et al. | 26/69 |
| 5,080,952 | A | | 1/1992 | Willbanks | 428/91 |
| 5,136,761 | A | | 8/1992 | Sternlieb et al. | 28/104 |
| 5,295,997 | A | | 3/1994 | Vuillaume et al. | 8/194 |
| 5,393,304 | A | | 2/1995 | Vuillaume et al. | 8/194 |
| 5,396,689 | A | | 3/1995 | Vuillaume | 28/103 |
| 5,404,626 | A | * | 4/1995 | Bylund et al. | 26/69 R |
| 5,475,905 | A | * | 12/1995 | Cockfield et al. | 28/163 |
| 5,487,936 | A | * | 1/1996 | Collier | 442/214 |
| 5,495,874 | A | | 3/1996 | Heiman | 139/420 A |
| 5,632,072 | A | | 5/1997 | Simon et al. | 26/69 |
| 5,657,520 | A | | 8/1997 | Greenway et al. | 26/51 |
| 5,718,022 | A | | 2/1998 | Vuillaume | 28/105 |
| 5,727,292 | A | | 3/1998 | Vuillaume | 28/104 |
| 5,737,813 | A | | 4/1998 | Sternlieb et al. | 28/167 |
| 5,768,756 | A | | 6/1998 | Noelle | 28/104 |
| 5,806,155 | A | | 9/1998 | Malaney et al. | 28/167 |
| 5,870,807 | A | | 2/1999 | Beaty et al. | 28/167 |
| 5,933,931 | A | | 8/1999 | Greenway | 28/167 |
| 5,943,745 | A | | 8/1999 | Dischler | 26/28 |
| 5,983,469 | A | | 11/1999 | Beaty et al. | 28/167 |
| 6,490,771 | B1 | * | 12/2002 | Nash et al. | 28/163 |
| 6,546,605 | B1 | * | 4/2003 | Emery et al. | 28/167 |

FOREIGN PATENT DOCUMENTS

| | | |
|---|---|---|
| WO | WO01/00412 | 1/2001 |

* cited by examiner

*Primary Examiner*—Amy B. Vanatta
(74) *Attorney, Agent, or Firm*—Terry T. Moyer; Sara M. Current

(57) ABSTRACT

A process for producing fancy woven fabrics having balanced hand characteristics on each of the face and back is described. The process involves hydraulically processing a fancy-woven fabric having spun yarns in the warp to force fibers from spun yarns which are dominant on one fabric surface through the fabric to regions to form a nap on the other surface of the fabric. The process achieves fabrics having balanced hand characteristics with superior strength to those formed by conventional napping and sanding processes. In addition, the patterns have good pattern clarity.

11 Claims, 9 Drawing Sheets

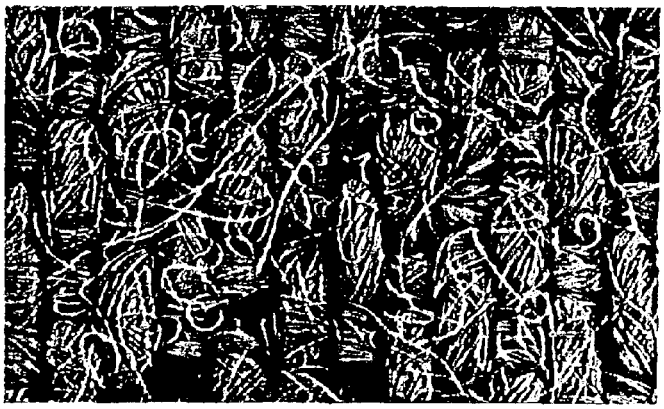
FIG. –1A–
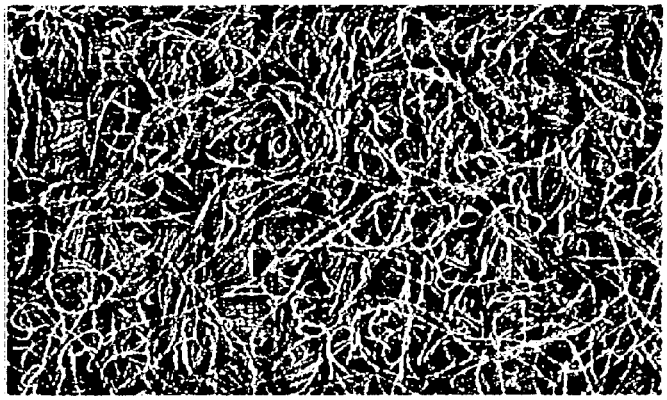
FIG. –1B–
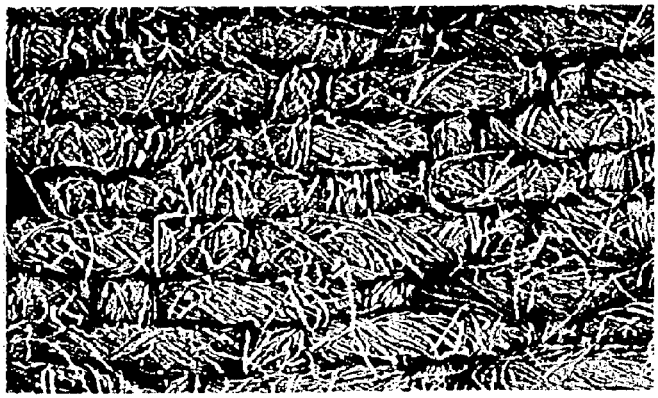
FIG. –1C–

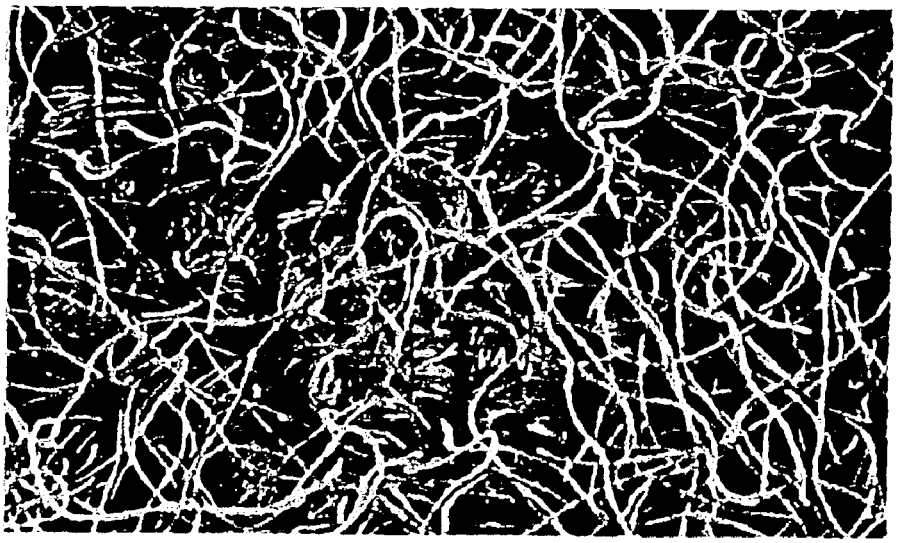
FIG. –7A–
PRIOR ART
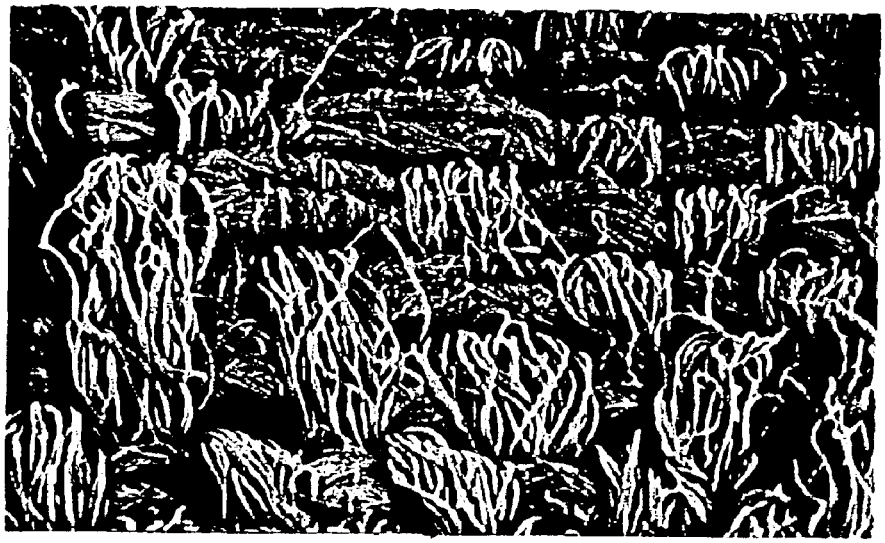
FIG. –7B–
PRIOR ART

HYDRAULIC NAPPING OF FABRICS WITH JACQUARD OR DOBBY PATTERNS

This application is a Divisional of application Ser. No. 09/708,931, filed on Nov. 8, 2000, now pending.

FIELD OF THE INVENTION

The invention generally relates to patterned fabrics having superior aesthetic and performance characteristics, and a method for making such fabrics, and products made from the fabrics. More specifically, the invention is directed to fancy woven fabrics having improved and drape balanced hand characteristics on front and back faces, superior strength characteristics, and improved pattern clarity, and methods for their production.

BACKGROUND

Fancy woven fabrics such as jacquard and dobby weaves are commonly used in a variety of products, including apparel, domestics such as napery and drapery, home furnishings, and the like. As will be readily understood by those of ordinary skill in the art, jacquard woven fabrics typically are elaborately designed, since the nature of jacquard weaving enables the control of individual yarns during the weaving process. Similarly, dobby weaves are characterized by small, angular repetitive designs produced by the selective control of groups of yarns.

Fancy weaves are characterized by predetermined changes in the interlacing of the warp and filling yarns to define base fabric regions and patterned regions. In other words, these types of fabrics are constructed by altering the weave of the fabric in such a way that a pattern becomes visible in the fabric construction itself, even when a single type of yarn is used to form both the warp and filling. This is achieved through the use of varying float lengths of the warp and/or filling yarns in the patterned region as compared with those used to form the base fabric. The pattern may also be created by using alternating twills (e.g. through the use of a right hand twill for the base fabric and a left hand twill in the pattern.) Typically, the image appearing on the back of these fabrics is approximately the opposite of the design on the fabric face. For example, where the warp yarn is predominant on the face of the fabric, the filling yarns will be predominant in the same region on the back of the fabric. Because of the variety of patterns which can be created using these types of weaving methods, such fabrics are often preferred over plain woven fabrics for aesthetic reasons.

By using spun warp yarns and filament filling yarns, the contrast between the patterned areas and the base fabric areas in fancy weave fabrics can be greatly enhanced. This is particularly evident on dyed fabrics, due to the different optical characteristics of filament and spun yarns. In other words, since the pattern in the fabric is generally defined by alternating regions where the warp or filling are predominant on the fabric face, the different optical characteristics (e.g., as a result of the difference in reflectance, dye uptake, texture, etc.) serve to enrich the appearance of the pattern. While fabrics using a combination of spun and filament yarns can provide a desirable visual pattern, the fabric can tend to have a harsh hand in the regions where the filament filling yarns are predominant.

Methods for enhancing the hand of such fancy woven fabrics have typically involved abrading the fabric surface with abrasive rolls or flaps. While providing an improvement over the untreated fabrics, the abrading tends to undesirably weaken the fabrics. In addition, these treatment methods tend to reduce the visibility of the pattern, thereby adversely impacting the aesthetic characteristics of the fabric.

SUMMARY

The invention provides a fancy woven fabric having desirable soft hand on both the fabric back and face. In addition, fabrics made according to the invention can be manufactured to achieve a balanced hand between the face and back of the fabric. In other words, the fabric can be produced so that the face of the fabric has approximately the same hand and feel as the back of the fabric, despite the fact that the filling yarns and warp yarns predominate in approximately opposite regions from the face to the back.

In addition, the fabrics have a superior appearance to sanded and napped fancy woven fabrics, with the clarity of the pattern being retained. Furthermore, fabrics napped according to the invention retain a much greater percentage of the strength they had prior to napping.

The process involves obtaining a fancy woven fabric comprising spun warp yarns. Preferably, the fabric comprises filament yarns in the filling. In one aspect of the invention the warp consists essentially of spun yarns while the filling consists essentially of filament yarns.

The fabric can be made of any type of fiber desired, but is preferably formed from substantially all synthetic fibers, such as polyester, nylon, polylactide based fibers and the like, and combinations thereof. As will be appreciated by those of ordinary skill in the art, fabrics made from substantially all synthetic fibers are generally expected to have inferior aesthetic characteristics from those made from all natural fibers or blends of natural and synthetic fibers. However, fabrics made according to the invention can be made from all synthetic fibers while still achieving aesthetic characteristics as good or better than those of fabrics containing natural fibers. For example, the fibers can be selected to provide a good combination of durability, washfastness, stain release, and the like. However, the process works well on natural fiber fabrics as well as synthetic fiber-containing fabrics.

As noted above, the warp desirably includes spun yarns, and preferably consists essentially of spun yarns, while the filling desirably comprises filament yarns and preferably consists essentially of filament yarns. The spun yarns can be those produced in any conventional manner, including but not limited to open end spun, air jet spun, ring spun, vortex spun, and the like. Filament yarns used can also be of any variety including but not limited to flat yarns, textured yarns, broken filament yarns and the like, and combinations thereof.

BRIEF DESCRIPTION OF THE DRAWINGS

FIG. 1A is photomicrograph (30× magnification) of the back of the Sample A fabric;

FIG. 1B is a photomicrograph (30× magnification) of the back of the Sample B fabric, which has been produced according to the instant invention;

FIG. 1C is a photomicrograph (30× magnification) of the back of the Sample C fabric, which is a conventional 50/50 polyester fabric;

FIG. 7A is a photomicrograph (27.8× magnification) of the face of the fabric of Sample F;

FIG. 7B is a photomicrograph (26.8× magnification) of the face of the fabric of Sample F;

DETAILED DESCRIPTION

Figure 2A:
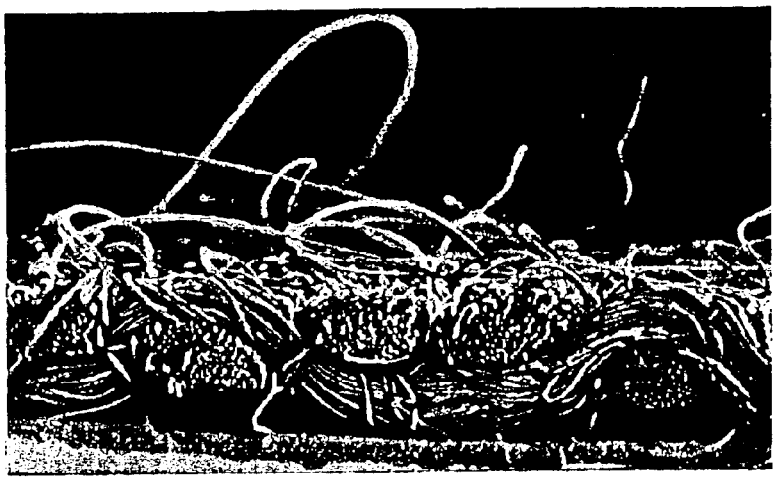
FIG. 2A is a photomicrograph (50× magnification) of a cross-section of the Sample A fabric, illustrating the sporadic fibers present on the fabric face.

In the following detailed description of the invention, specific preferred embodiments of the invention are described to enable a full and complete understanding of the invention. It will be recognized that it is not intended to limit the invention to the particular preferred embodiment described, and although specific terms are employed in describing the invention, such terms are used in a descriptive sense for the purpose of illustration and not for the purpose of limitation.

The invention provides a fancy woven fabric having desirable balanced hand characteristics between the face and back of the fabric. In addition, the fabrics have a superior appearance and hand to sanded and napped fancy woven fabrics. Furthermore, fabrics made according to the invention retain a much greater percentage of their pre-napped strength.

The process involves obtaining a fancy woven fabric comprising spun warp yarns. Preferably, the fabric also includes filament yarns in the filling. In one aspect of the invention the warp consists essentially of spun yarns while the filling consists essentially of filament yarns.

The fabric can be made of any type of fiber desired, but is preferably formed from substantially all synthetic fibers, such as polyester. However, fabrics made from other types of synthetic and/or natural fibers, including but not limited to nylon, polylactide based fibers, cotton, rayon, and the like, and combinations thereof, can be used within the scope of the invention.

The fabric can be of essentially any weight desired, but is desirably from about 3 to about 12 oz/sq yd, and more desirably about 4 to about 8 oz/sq yd. This weight range is particularly desirable for fabrics which are to be used in the manufacture of napery articles such as tablecloths and napkins, and fabrics used in the production of drapery.

As noted above, the warp desirably includes spun yarns, and preferably consists essentially of spun yarns, while the filling desirably comprises filament yarns and preferably consists essentially of filament yarns. The spun yarns can be those produced in any conventional manner, including but not limited to open end spun, air jet spun, ring spun, vortex spun, and the like. Filament yarns used can also be of any variety, including but not limited to textured yarns, flat yarns, broken filament yarns, etc. and combinations thereof.

The fabric is preferably prepared to remove size, oils, waxes, and the like which may have accumulated during the manufacturing operation. The fabric is then hydraulically processed to raise the fibers and soften the fabric. For example, the fabric can be processed through an apparatus which contacts the fabric with a number of tiny jets of high-pressure water which serve to move a number of the individual fibers away from the yarn bundle and to the fabric surface. One example of a hydraulic face finishing process is commonly-assigned U.S. Pat. No. 5,080,952 to Wilbanks, the disclosure of which is incorporated herein by reference. Examples of equipment which can be used to hydraulically treat the fabrics are manufactured by Textile Enhancements International, Inc. and Fleissner GmbH & Co., and Reiter/Perfojet, Inc. A process which is particularly preferred for processing the fabrics of the invention is described in commonly-assigned co-pending U.S. patent application Ser. No. 09/344,596 for "Napped Fabric and Process", filed Jun. 25, 1999 by Emery et al, the disclosure of which is incorporated herein by reference.

One process for forming the fabrics of the invention involves hydraulically treating both the front and back faces of the fabric, in some cases, with less jet force on one face of the fabric than the other. For example, in one arrangement which performs well in the invention, an apparatus having approximately 40 jets/inch acts on one face of the fabric with a pressure of about 1050 psi using a jet velocity of about 395 ft/s, and a flow rate of water of about 480 gpm, for a total force exerted on the fabric by water of about 410 lbs. and a total energy imparted to the fabric of approximately 294 hp, while a 575 psi pressure is applied by a secondary nozzle to the other side of the fabric using a jet velocity of about 292 ft/s and a flow rate of water of about 354 gpm, for a total force exerted on the fabric by water of approximately 224 lbs. and total energy imparted to the fabric of approximately 119 hp. Fabrics processed according to these parameters were processed at a speed of approximately 35 yards per minute. It has been found that this process acts primarily on the yarns in the warp direction (which as noted above, are preferably spun yarns), thereby expanding and opening the yarns such that more individual fiber ends and loops are exposed on the surface of the fabric. This creates a soft pile-like surface on the fabric. In addition, this process tends to force fibers from the spun yarns around the filament yarns, thereby providing a nap to both surfaces of the fabric. In this way, a fancy woven fabric which has balanced hand characteristics between the two sides can be achieved. Also, it has been found that this process can be used to achieve fancy woven fabrics with superior pattern definition and aesthetic characteristics.

As noted above, the fabrics made according to the invention have desirable hand characteristics, and the hand of the fabric face is approximately equal to that of the fabric back. Preferably, the fabric has a shear stiffness of less than about 1.7, and more preferably less than about 1.5. The fabric also desirably has a MIU value of >0.25 on each of its sides, more preferably greater than about 0.26, and even more preferably about 0.265 or greater. The fabric also desirably has an SMD value on each surface of less than about 12, and more preferably less than about 11.5. In addition, the difference between the SMD values of the front and back of the fabric is desirably about one or less, and more preferably about 0.5 or less.

EXAMPLES

Sample A was woven in a 2 ×1 alternating twill weave construction having 78 ends per inch of 19/1 open end spun polyester in the warp and 60 picks per inch of 2/150/34 textured broken filament type yarn in the filling. (As will be appreciated by those of ordinary skill in the art, broken filament yarns are processed such that some of the loops formed in air jet texturing are broken.) The fabric was prepared in a conventional manner to remove size, oils, waxes and the like which may have accumulated during the manufacturing operations, then dyed and heatset. There was no face finishing operation performed to this control fabric. The fabric had a weight of 6.3 oz./sq. yd.

Sample B was the same fabric as Sample A, with the exception that the fabric was hydraulically treated in the manner of the invention prior to dyeing and heatsetting. Specifically, the fabric was processed on an apparatus having approximately 40 jets/inch which acted on one face of the fabric with a pressure of about 1050 psi using a jet velocity of about 395 ft/s, and a flow rate of water of about 480 gpm, for a total force exerted on the fabric by water of about 410 lbs. and a total energy imparted to the fabric of 294 hp, while a 575 psi pressure was applied by the secondary nozzle to the other side of the fabric using a jet velocity of about 292 ft/s and a flow rate of water of about 354 gpm, for a total force exerted on the fabric by water of about 224 lbs. and total energy imparted to the fabric of about 119 hp. Fabrics processed according to these parameters were processed at a speed of about 35 yards per minute.

Sample C was a conventional 50/50 polyester/cotton fabric commonly used in the napery market. The fabric had a weight of about 6.3 oz/sq yd, and was woven in a 4×1 twill weave construction with 81 ends by 81 picks of 19.5/1 polyester/cotton blended yarn. The fabric had not undergone any form of face finishing.

Sample D was a woven jacquard fabric having 78 ends of 19/1 open end spun polyester yarn in the warp and 60 picks of 2/150/34 air jet textured broken filament yarns in the filling. The fabric was prepared in a conventional manner to remove size, oils, waxes and the like which may have accumulated during the manufacturing operations, then dyed and heatset. There was no face finishing operation performed to this control fabric.

Sample E was the same fabric as Sample D, but the fabric was hydraulically processed in the manner of the instant invention prior to dyeing and heatsetting. In particular, the fabric was processed on an apparatus having approximately 40 jets/inch which acted on one face of the fabric with a pressure of approximately 1050 psi using a jet velocity of about 395 ft/s, and a flow rate of water of about 480 gpm, for a total force exerted on the fabric by water of about 410 lbs. and a total energy imparted to the fabric of approximately 294 hp, while a 575 psi pressure was applied by the secondary nozzle to the other side of the fabric using a jet velocity of about 292 ft/s and a flow rate of water of about 354 gpm, for a total force exerted on the fabric by water of about 224 lbs. and total energy imparted to the fabric of about 119 hp. Fabrics processed according to these parameters were processed at a speed of about 35 yards per minute.

Sample F was the same fabric as Sample D, but the fabric was napped using a commercial napping machine of the variety marketed by Woonsocket, Inc. The fabric was napped twice on the face and once on the back. The large roll on the machine turned against the direction of fabric motion, while the small rolls turned with the fabric. The wire on the napping machine was ⅜" long and of medium stiffness.

Sample G was the same fabric as Sample D, but the fabric was sanded in a conventional manner. The fabric was processed at 20 yards per minute (ypm). Both sides of the fabric wire sanded with four 330 diamond grit rolls using the process described in commonly-assigned U.S. Pat. No. 5,943,745 to Dischler, the disclosure of which is incorporated herein by reference. The sanding rolls had a surface speed of 8 times the fabric speed. Alternate rolls turned against the fabric and the other rolls turned with the fabric. (i.e. odd rolls turned against the fabric, while even rolls turned with the fabric.)

The sample fabrics were tested using the following test methods, and the results are listed in the tables below.

Test Methods:

The fabrics were all tested to determine the following characteristics using the Kawabata Evaluation System ("Kawabata System"). The Kawabata System was developed by Dr. Sueo Kawabata, Professor of Polymer Chemistry at Kyoto University in Japan, as a scientific means to measure, in an objective and reproducible way, the "hand" of textile fabrics. This is achieved by measuring basic mechanical properties that have been correlated with aesthetic properties relating to hand (e.g. smoothness, fullness, stiffness, softness, flexibility, and crispness), using a set of four highly specialized measuring devices that were developed specifically for use with the Kawabata System. These devices are as follows:

Kawabata Tensile and Shear Tester (KES FB1)
Kawabata Pure Bending Tester (KES FB2)
Kawabata Compression Tester (KES FB3)
Kawabata Surface Tester (KES FB4)

KES FB1 through 3 are manufactured by the Kato Iron Works Col, Ltd., Div. Of Instrumentation, Kyoto, Japan. KES FB4 (Kawabata Surface Tester) is manufactured by the Kato Tekko Co., Ltd., Div. Of Instrumentation, Kyoto, Japan. In each case, the measurements were performed according to the standard Kawabata Test Procedures, with 4 8-inch×8-inch samples of each type of fabric being tested, and the results averaged. Care was taken to avoid folding, wrinkling, stressing, or otherwise handling the samples in a way that would deform the sample. The fabrics were tested in their as-manufactured form (i.e. they had not undergone subsequent launderings.) The die used to cut each sample was aligned with the yarns in the fabric to improve the accuracy of the measurements.

Shear Measurements

The testing equipment was set up according to the instructions in the Kawabata manual. The Kawabata shear tester (KES FB1) was allowed to warm up for at least 15 minutes before being calibrated. The tester was set up as follows:

Sensitivity: 2 and ×5
Sample width: 20 cm
Shear weight: 195 g
Tensile Rate: 0.2 mm/s
Elongation Sensitivity: 25 mm The shear test measures the resistive forces when the fabric is given a constant tensile force and is subjected to a shear deformation in the direction perpendicular to the constant tensile force.

Mean Shear Stiffness (G) [gf/(cm-deg)]. A lower value for shear stiffness is indicative of a more supple hand.

Shear hysteresis (2HG05)—Shear hysterisis at 0.5° [gf/cm]—A lower value indicates that the fabric recovers more completely from shear deformation. This correlates to a more supple hand.

Surface Test

The testing equipment was set up according to the instructions in the Kawabata Manual. The Kawabata Surface Tester (KES FB4) was allowed to warm up for at least 15 minutes before being calibrated. The tester was set up as follows:

Sensitivity 1: 2 and ×5
Sensitivity 2: 2 and ×5
Tension Weight: 480 g
Surface Roughness Weight: 10 g
Sample Size: 20×20 cm The surface test measures frictional properties and geometric roughness properties of the surface of the fabric.

Coefficient of Friction (MIU)—Mean coefficient of friction [dimensionless]. Higher value indicates that the surface consists of more fiber ends and loops. This gives the fabric a soft, fuzzy hand.

Surface Roughness (SMD)—Mean deviation of the displacement of contactor normal to surface [microns]. Indicative of the roughness of the fabric surface. High SMD values are associated with poor hand.

Bending

The testing equipment was set up according to the instructions in the Kawabata Manual. The Kawabata Bending Tester (KES FB2) was allowed to warm up for at least 15 minutes before being calibrated. The tester was set up as follows:

Sensitivity: 2 and ×1
Sample Size: 20×20 cm

The bending test measures the resistive force encountered when a piece of fabric that is held or anchored in a line parallel to the warp or filling is bent in an arc. The fabric is bent first in the direction of one side and then in the direction of the other side. This action produces a hysteresis curve since the resistive force is measured during bending and unbending in the direction of each side. The width of the fabric in the direction parallel to the bending axis affects the force. The test ultimately measures the bending momentum and bending curvature.

Bending Stiffness (B)—Mean bending stiffness per unit width [gf-cm$^2$/cm]. Lower value indicates a more supple hand.

Bending hysteresis (2HB05)—Mean width of bending hysteresis per unit width at K=0.5 cm$^{-1}$ [gf-cm/cm]. Lower value means the fabric recovers more completely from bending.

Compression

The testing equipment was set up according to the instructions in the Kawabata manual. The Kawabata Compression Tester (KES FB3) was allowed to warm up for at least 15 minutes before being calibrated. The tester was set up as follows:

Sensitivity: 2 and ×5
Stroke: 5 mm
Compression Rate: 1 mm/50 s
Sample Size: 20×20 cm The compression test measured the resistive forces experienced by a plunger having a certain surface area as it moves alternately toward and away from a fabric sample in a direction perpendicular to the fabric. The test ultimately measures the work done in compressing the fabric (forward direction) to a preset maximum force and the work done while decompressing the fabric (reverse direction).

% Compressibility—0.5 grams—(COMP05) A larger value indicates the fabric has more loft.

Minimum Density—0.5 grams—(DMIN)—Fabric density at thickness TMIN[g/cm$^3$] A less dense fabric is usually more supple and soft.

Maximum Density—50 grams—(DMAX)—Fabric density at thickness TMAX[g/cm$^3$] A less dense fabric is usually more supple and soft.

Linearity of Compression—0.5 grams—(LC05)—Compares compression work with the work along a hypothetical straight line from ($X_0$, $y(X_0)$) to ($X_{max}$, $y(X_{max})$). The larger the value, the more linear the compression. This indicates that the fabric is more isotropic in behavior.

Minimum Thickness—0.5 grams—(TMIN)—Thickness [mm] at minimum gf/cm$^2$).

Maximum Thickness (TMAX)—Thickness [mm] at maximum pressure (nominal is 50 gf/cm$^2$).

Compressional Energy (WC)—Energy to compress fabric to 50 gf/cm$^2$[gf-cm/cm$^2$]. A higher number means that the fabric has more loft and is able to retain more loft during compression.

Decompressional Energy (WC')—This is an indication of the resilience of the fabric, with a larger number indicating greater resiliency.

Strength

Tensile Strength—Tensile strength was measured in each of the warp and filling directions according to ASTM D5034. (Grab Test Method.)

Tear Strength—Tear strength was measured in each of the warp and filling directions according to ASTM D5733 (Trap Test Method.)

TABLE A

| PARAMETER | Sample A | Sample B | Sample C |
|---|---|---|---|
| G (shear stiffness) | 1.798 | 1.484 | — |
| 2HG05 (shear hysteresis) | .978 | .986 | — |
| MIU (coefficient of friction) face | .248 | .284 | .228 |
| MIU (coefficient of friction) back | .249 | .269 | .213 |
| SMD (surface roughness) face | 14.029 | 11.402 | 11.73 |
| SMD (surface roughness) back | 12.288 | 11.048 | 9.885 |
| B (bending stiffness) | .283 | .333 | — |
| 2HB05 (bending hysteresis) | .207 | .217 | — |
| COMP05 (% compressibility) | 41.812 | 44.143 | 32.621 |
| DMIN (minimum density) | .256 | .197 | .321 |
| DMAX (maximum density) | .440 | .353 | .477 |
| LC05 (linearity of compression) | .333 | .403 | .284 |
| TMIN (minimum thickness) | .831 | 1.076 | .711 |
| TMAX (maximum thickness) | .483 | .601 | .479 |
| WC (compressional energy) | .289 | .478 | .165 |
| WC' (decompressional energy) | .146 | .221 | .071 |

TABLE B

| | Sample D | Sample E | Sample F | Sample G |
|---|---|---|---|---|
| Tensile Strength (Warp) (lbs.) | 177.1 | 159.0 (89.78% of pre-napped) | 192.2 (108.5% of pre-napped) | 151.0 (85.26% of pre-sanded) |
| Tensile Strength (Filling) (lbs.) | 190.1 | 214.1 (112.6% of pre-napped) | 38.0 (19.99% of pre-napped) | 44.7 (23.51% of pre-sanded) |
| Tear Strength (Warp) (lbs.) | 26.8 | 23.4 (87.31% of pre-napped) | 25.3 (94.4% of pre-napped) | 26.5 (98.88% of pre-sanded) |
| Tear Strength (Filling) (lbs.) | 39.7 | 38.3 (96.47% of pre-napped) | 8.7 (21.92% of pre-napped) | 12.2 (30.73% of pre-sanded) |

Referring now to the drawings, FIG. 1A is a photomicrograph (30× magnification) of the back of the Sample A (control) fabric, FIG. 1B is a photomicrograph (30× magnification) of the back of the Sample B fabric (i.e., the Sample A fabric hydraulically napped according to the invention), and FIG. 1C is a photomicrograph (30× magnification ) of the back of the Sample C polyester/cotton blended fabric. The Sample C fabric is representative of a conventional fabric used in commercial napery applications. As is clear from the photographs, the Sample B fabric shown in FIG. 1B has a large number of fiber loops and ends defining a lofty nap. As will readily be appreciated by those of ordinary skill in the art, this nap provides the fabric with a much softer, more plush feel. In fact, as illustrated by the comparison of FIG. 1B (Sample B fabric) with FIG. 1C (Sample C poly/cotton fabric), the fabric made according to the invention has more pile on its surface than that of the poly/cotton fabric. With reference to Table A, the fabric of the invention also has a greater percentage compressibility (COMP05) than that of the control and the Sample C poly/cotton fabric. This indicates that the fabric has more loft than either the Sample A or B fabrics.

The Sample B fabric also had lower DMIN and DMAX values as compared with both the Sample A and Sample C fabrics. Lower DMIN and DMAX are indicative of lower fabric density, which typically indicates that a fabric is more supple and soft than one with higher DMIN and DMAX values. The Sample B fabric also had higher linearity of compression. A larger linearity of compression indicates that the fabric is more isotropic in behavior than one with a lower LC value.

The Sample B fabric also had greater TMIN and TMAX values than both the Sample A and Sample C fabrics. These measurements are indicative of the thickness the fabric has when experiencing a certain compressive force levels (i.e. TMIN at 0.5 g/cm$^2$ and TMAX at 50 g/cm$^2$.) Greater thickness is indicative of more loft and a softer hand.

The Sample B fabric also had greater compressional energy (WC) and decompressional energy (WC') than either the Sample A or Sample C fabrics. A higher compressional energy measurement means the fabric has more loft and is able to retain more loft during compression. A higher decompressional energy measurement corresponds to greater fabric resiliency (i.e. the ability to recover from compressional force). All of these enhancements in aesthetic characteristics were also achieved with little detriment to other characteristics, such as bending hysteresis (reflects ability of fabric to recover from bending), bending stiffness (indicative of suppleness of hand) and shear hysteresis (indicative of degree to which fabric recovers from shear deformation.)

The Sample B fabric also had higher MIU values than both the Sample A and Sample C fabrics. A higher MIU (coefficient of friction) value indicates that the fabric surface has more fiber ends and loops, thereby giving the fabric a soft, fuzzy hand. In addition, the MIU values for the face and back of the fabric were relatively close to each other, which indicates that the fabric has a similar amount of fiber ends and loops on each of the face and back.

Figure 2B:
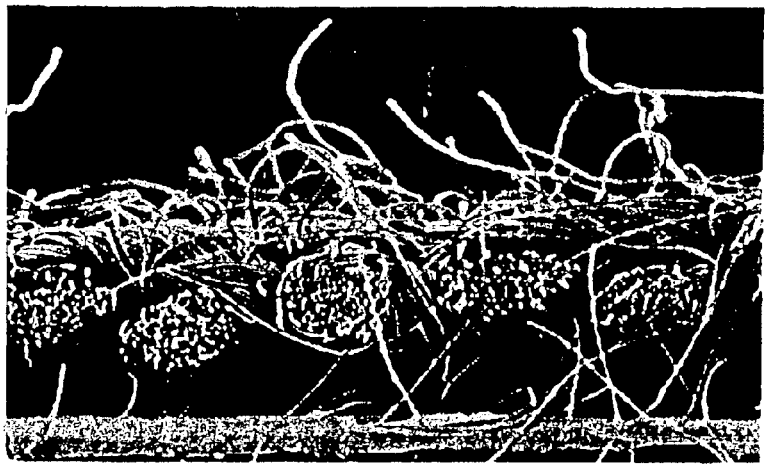
FIG. 2B is a photomicrograph (50× magnification) of a cross-section of the Sample A fabric, illustrating the sporadic fibers present on the fabric back.

FIG. 2A is a photomicrograph (50× magnification) of a cross-section of the Sample A fabric, illustrating the sporadic fibers present on the fabric face. FIG. 2B is a photomicrograph (50× magnification) of a cross-section of the Sample A fabric, illustrating the sporadic fibers present on the fabric back.

Figure 3A:
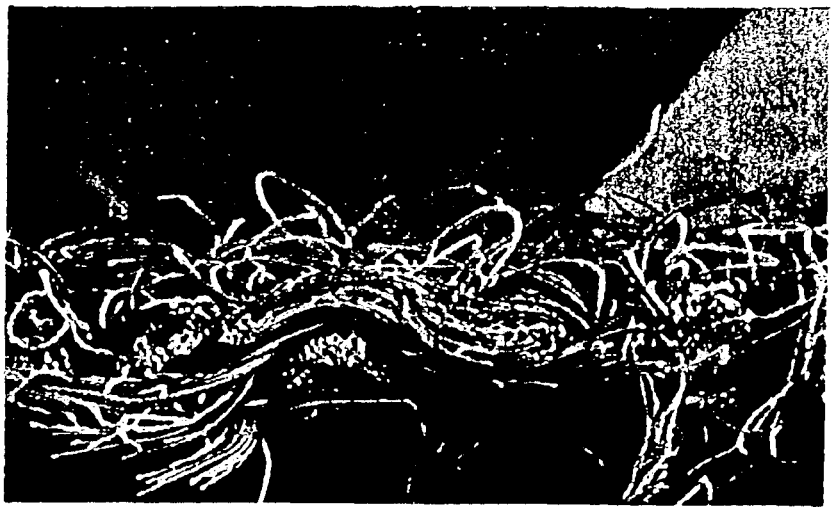
FIG. 3A is a photomicrograph (50× magnification) of a cross-section of the Sample B fabric, illustrating the dense, even pile on the fabric face.
Figure 3B:
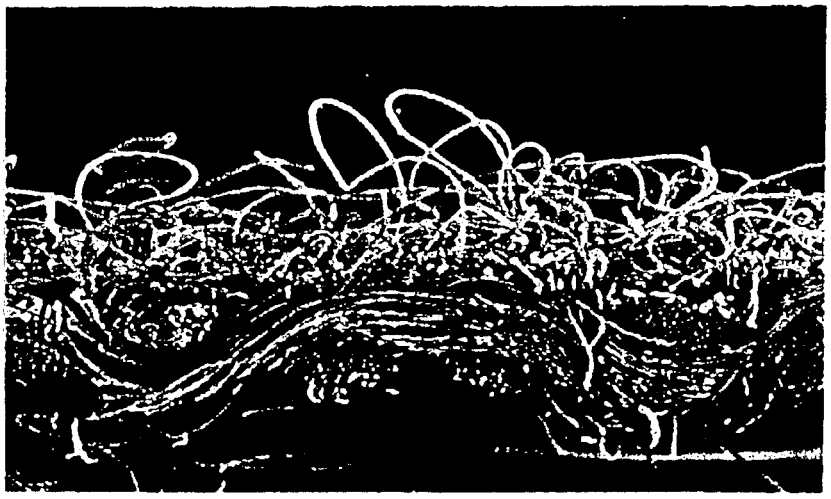
FIG. 3B is a photomicrograph (50× magnification) of a cross-section of the Sample B fabric, illustrating the dense, even pile on the fabric back.

FIG. 3A is a photomicrograph (50× magnification) of a cross-section of the Sample B fabric, illustrating the dense, even pile on the fabric face. FIG. 3B is a photomicrograph (50× magnification) of a cross-section of the Sample B fabric, illustrating the dense, even pile on the fabric back.

Figure 4A:
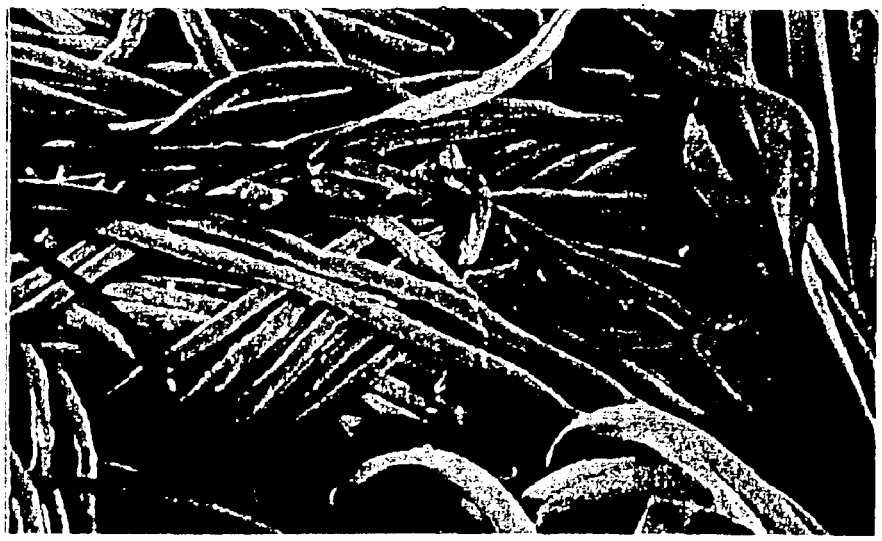
FIG. 4A is a photomicrograph (250× magnification) of several yarns from the Sample D fabric.
Figure 4B:
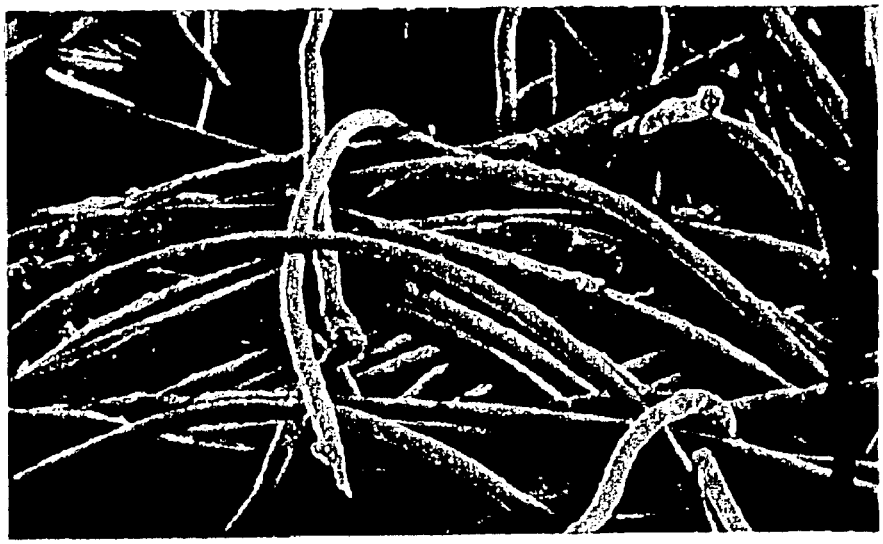
FIG. 4B is a photomicrograph (250× magnification) of several yarns from the Sample E fabric.
Figure 4C:
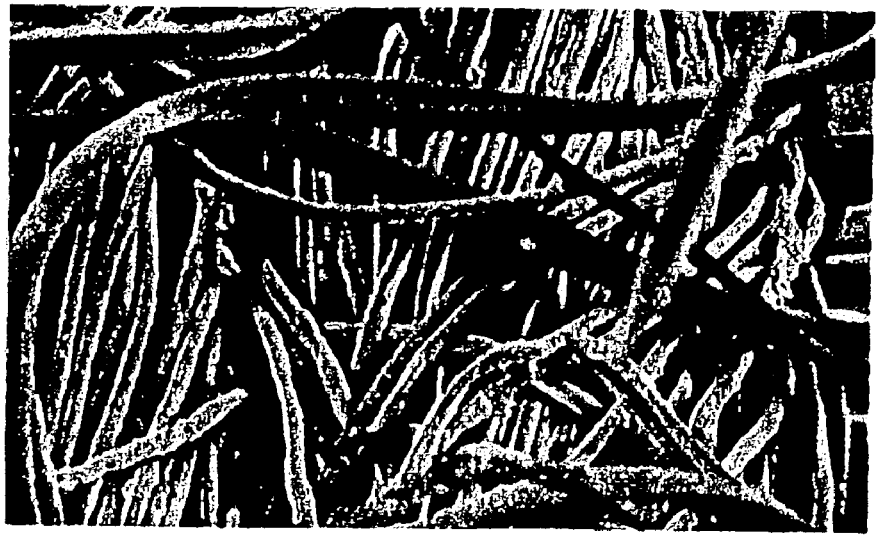
FIG. -4C- PRIOR ART
FIG. 4C is a photomicrograph (250× magnification) of several yarns from the Sample F napped fabric.
Figure 4D:
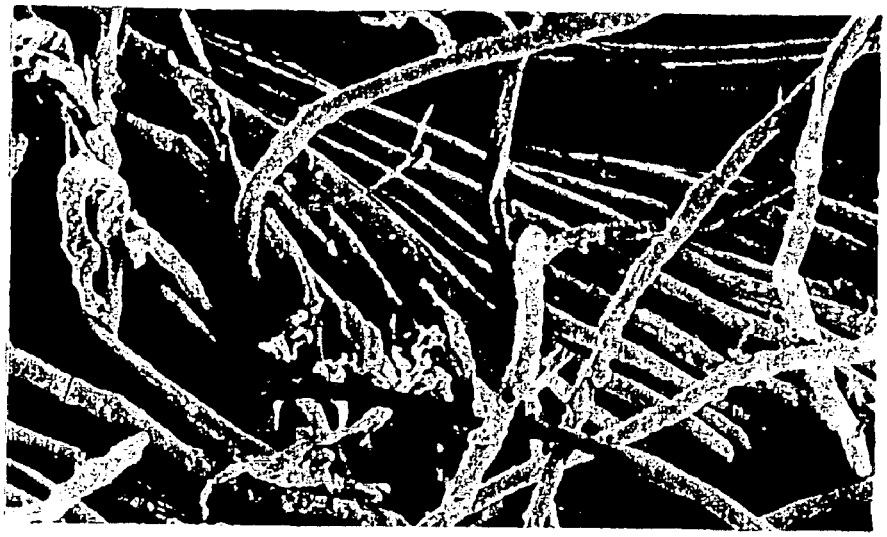
FIG. -4D- PRIOR ART
FIG. 4D is a photomicrograph (250× magnification) of several yarns from the Sample G sanded fabric.

FIG. 4A is a photomicrograph (250× magnification) of several yarns from the Sample D fabric, while FIG. 4B is a photomicrograph (250× magnification) of several yarns from the Sample E fabric. FIG. 4C is a photomicrograph (250× magnification) of several yarns from the Sample F napped fabric, and FIG. 4D is a photomicrograph (250× magnification) of several yarns from the Sample G sanded fabric. As is readily apparent, the Sample D yarn has no damage (since is has not been napped), but it would have an inferior hand to one which has been treated. FIG. 4B shows a yarn which has been lofted, but not damaged. As will be readily appreciated by those of ordinary skill in the art, this yarn would provide superior hand characteristics than the untreated yarns illustrated in FIG. 4A. In contrast, FIGS. 4C and 4D illustrate yarns containing fibers which have been damaged and broken as a result of the napping and sanding processes (respectively). Fibers experiencing such damage will have lower strength characteristics than fibers which are undamaged.

Figure 5A:
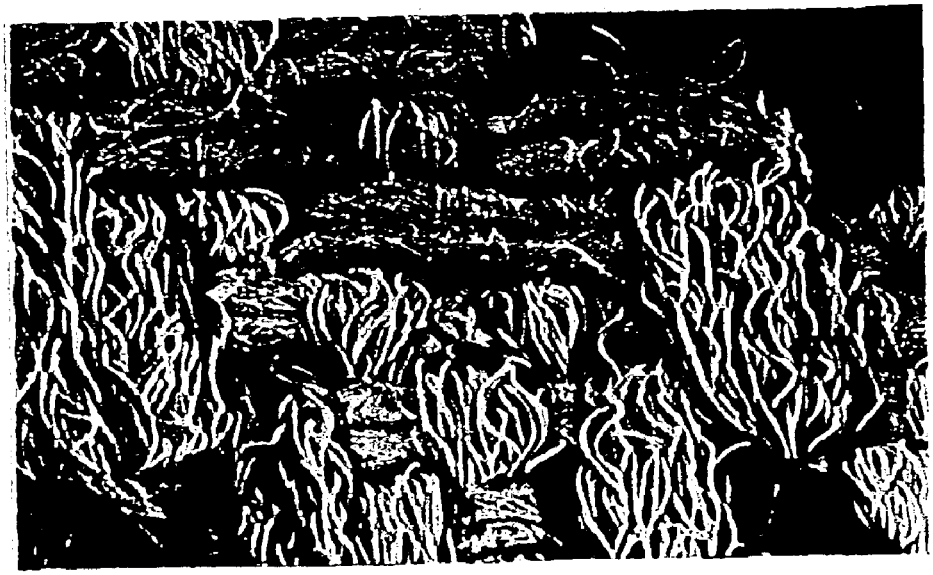
FIG. 5A is photomicrograph (26.8× magnification) of the face of the fabric of Sample D.
Figure 5B:
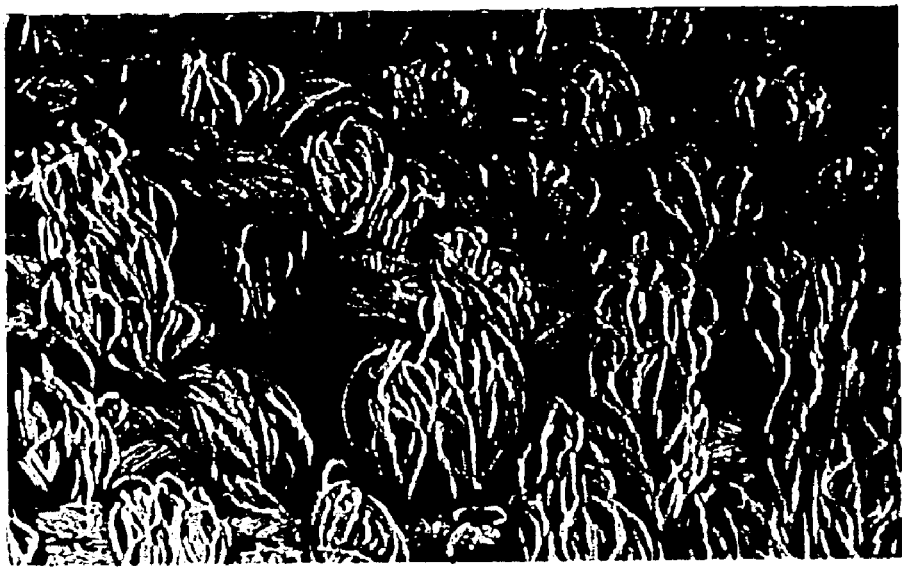
FIG. 5B is a photomicrograph (26.8× magnification) of the back of the fabric of Sample D.
Figure 6A:
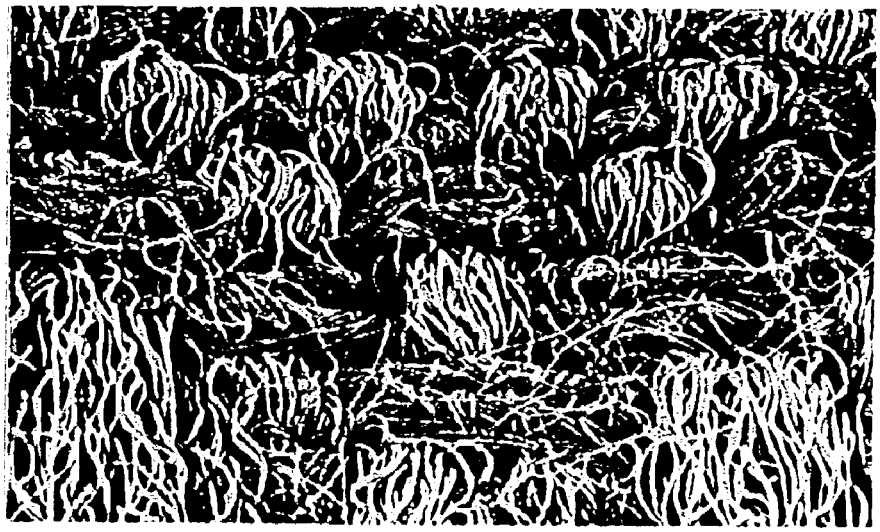
FIG. 6A is a photomicrograph (26.8× magnification) of the face of the fabric of Sample E.
Figure 6B:
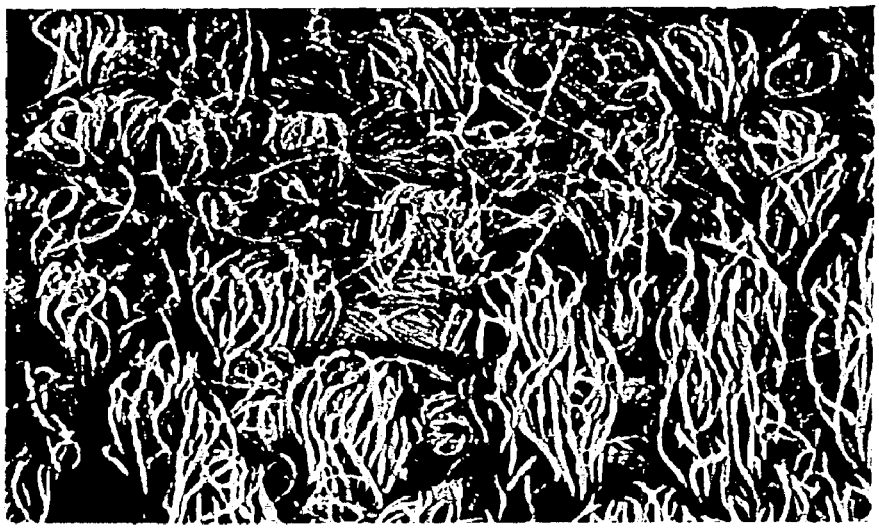
FIG. 6B is a photomicrograph (26.8× magnification) of the face of the fabric of Sample E.
Figure 8A:
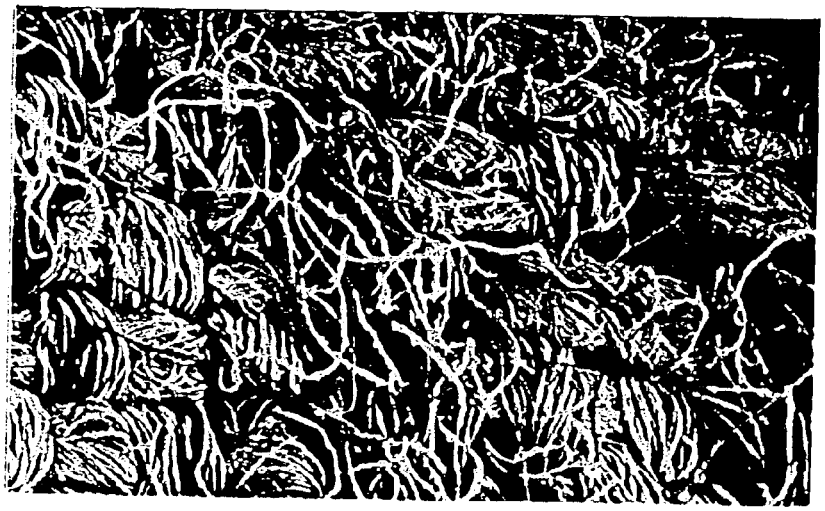
FIG. -8A- PRIOR ART
FIG. 8A is a photomicrograph (26.8× magnification) of the face of the fabric of Sample G.
Figure 8B:
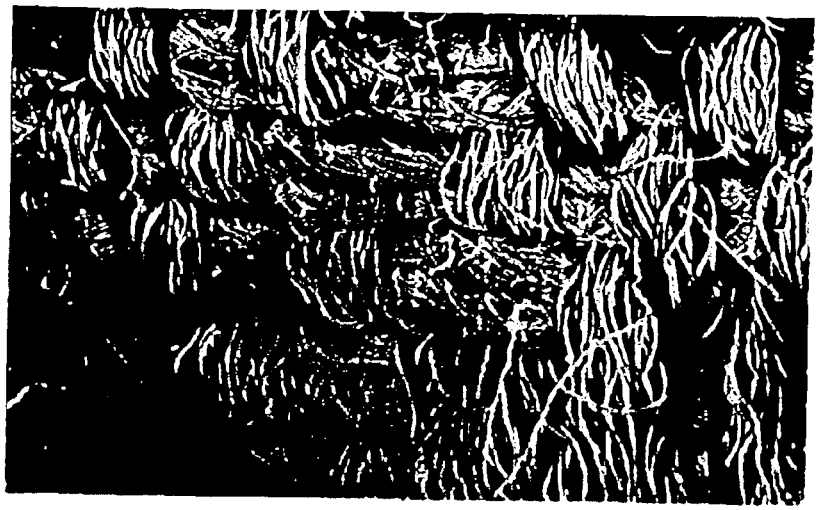
FIG. -8B- PRIOR ART
FIG. 8B is a photomicrograph (26.8× magnification) of the face of the fabric of Sample G.

FIG. 5A is photomicrograph (26.8× magnification) of the face of the fabric of Sample D, and FIG. 5B is a photomicrograph (26.8× magnification) of the back of the fabric of Sample D. FIG. 6A is a photomicrograph (26.8× magnification) of the face of the fabric of Sample E, while FIG. 6B is a photomicrograph (26.8× magnification) of the face of the fabric of Sample E. FIG. 7A is a photomicrograph (27.8× magnification) of the face of the fabric of Sample F, and FIG. 7B is a photomicrograph (26.8× magnification) of the face of the fabric of Sample F. FIG. 8A is a photomicrograph (26.8× magnification) of the face of the fabric of Sample G, and FIG. 8B is a photomicrograph (26.8× magnification) of the face of the fabric of Sample G. As is clear from these photomicrographs, the fabric of the invention retains clear pattern definition, with balanced aesthetic characteristics between the front and back sides. In addition, the Sample E fabric appears much softer than the Sample D control fabric. Furthermore, the Sample E fabric does not have the mass of broken fiber ends apparent on the faces of the napped and sanded fabrics of Samples F and G.

The Sample E fabric retained 89.78% of its pre-napped tensile strength in the warp direction after napping, and the tensile strength actually increased to 112.6% of its pre-napped strength in the filling direction. (It is believed that this is due to the fiber entanglement achieved by the hydroentanglement process.) In addition, the Sample E fabric retained 87.31% of its pre-napped tear strength in the warp direction, and 96.47% of its pre-napped tear strength in the filling direction. In contrast, the napped fabric of Sample F, while having a slightly higher warp tensile strength following napping (108.5% of pre-napped level), retained only 19.99% of its filling tensile strength following napping. Furthermore, while retaining 94.4% of its pre-napped warp tear strength, the fabric retained only 21.92% of its filling tear strength following napping.

Similarly, the Sample G sanded product had significantly lower strength than the fabric of the invention. While the sanded fabric retained 85.26% of its pre-napped warp tensile strength, it retained only 23.51% of its filling tensile strength. In addition, while the fabric retained 98.88% of its initial warp tear strength, it retained only 30.73% of its filling tear strength. Therefore, it was readily apparent that the fabric of the invention retains good strength characteristics in both the warp and filling direction, while the sanded and conventionally-napped fabrics experienced dramatic losses in strength, particularly in the filling direction.

The fabrics of the invention can be used in virtually any application. However, because of the defined patterns, good aesthetic characteristics, and strong fabrics which can be obtained, they have been found to be particularly useful in the manufacture of napery products, such as tablecloths and napkins used in restaurants and the like. In addition, such fabrics have been found to perform well in the production of drapery and home furnishing products. However other end uses, including but not limited to apparel, upholstery, wall coverings, and the like, are contemplated within the scope of the invention.

In the specification there has been set forth a preferred embodiment of the invention, and although specific terms are employed, they are used in a generic and descriptive sense only and not for purpose of limitation, the scope of the invention being defined in the claims.

We claim:

1. A method of making fancy woven fabrics having superior aesthetic characteristics comprising the steps of:

providing a fancy woven fabric having spun warp yarns and filament filling yarns defining a pattern of alternating regions where groups of the warp or filing yarns are predominant on the fabric face;

hydraulically treating the fabric so as to form a nap on regions of said fancy woven fabric where the filament filling yarns are predominant.

2. The method according to claim 1, wherein said step of hydraulically treating the fabric comprises impacting both sides of the fabric with jets of fluid.

3. The method according to claim 2, wherein said step of hydraulically treating the fabric comprises impacting one side of the fabric with jets of fluid at a first pressure, and impacting the other side of the fabric with jets of fluid at a second pressure which is less than said first pressure.

4. The method according to claim 1, wherein said fabric has a face and back, and wherein said step of hydraulically treating the fabric comprises hydraulically treating the fabric such that the hand of the fabric face is approximately equal to the hand of the fabric back.

5. The method according to claim 4, wherein said step of hydraulically treating the fabric is performed such that each side of said fabric has a Kawabata System MIU value of greater than about 0.25.

6. The method according to claim 1, wherein said fabric has a face adn back, and wherein said step fo hydraulically treating the fabric is performed such that the difference between th eKawabata System SMD values for the fabric face snd back is less than about 2.

7. The method according to claim 6, wherein said step of hydraulically treating the fabric is performed such that the difference between the Kawabata System SMD values for the fabric face and back is less than about 1.

8. The method according to claim 1, wherein said fabric has a face and back, and wherein said step of hydraulically treating the fabric is performed such that the difference between the Kawabata System SMD values for the fabric face and back is less than about 0.5.

9. A method for improving the hand of a fancy woven fabric having spun yarns in the warp and filament yarns in the filling comprising the steps of:

providing a fancy woven fabric having spun warp yarns and filament filing yarns defining a pattern of alternating regions where groups o fthe warp or filling yarns are predominant on the fabric face, and hydraulically treating the fabric to push fiber loops from said spun yarns over said filament yarns, to thereby provide a nap on said filament yarns without significantly reducing the strength of the fabric.

10. The method according to claim 9, wherein said hydraulic treatment is performed such that the tensile strength of the napped fabric in the filling direction is at least about 50% of its pre-napped strength.

11. The method according to claim 9, wherein said hydraulic treatment is performed such that the tensile strength of the napped fabric in the filling direction is at least about 75% of its pre-napped strength.

* * * * *

UNITED STATES PATENT AND TRADEMARK OFFICE

CERTIFICATE OF CORRECTION

PATENT NO. : 6,862,781 B2
DATED : March 8, 2005
INVENTOR(S) : Emery et al.

It is certified that error appears in the above-identified patent and that said Letters Patent is hereby corrected as shown below:

Column 12,
Line 4, please delete “adn” after the word “face” and insert -- and --
Line 4, please delete “fo” after the word “slep” and insert -- of --
Line 6, please delete “th eKawabata” after the word “between” and insert -- the Kawabata --
Line 7, please delete “snd” after the word “face” and insert -- and --
Line 23, please delete “o fthe” after the word “groups” and insert -- of the --

Signed and Sealed this

Twenty-fourth Day of May, 2005

JON W. DUDAS
*Director of the United States Patent and Trademark Office*